US006805621B2

(12) United States Patent
Hertelendi et al.

(10) Patent No.: US 6,805,621 B2
(45) Date of Patent: Oct. 19, 2004

(54) RAIL GRINDING MACHINE

(75) Inventors: Josef Hertelendi, Freilassing (DE); Otto Widlroither, Freilassing (DE)

(73) Assignee: Robel Bahnbaumaschinen GmbH, Freilassing (DE)

( * ) Notice: Subject to any disclaimer, the term of this patent is extended or adjusted under 35 U.S.C. 154(b) by 0 days.

(21) Appl. No.: 10/462,309

(22) Filed: Jun. 13, 2003

(65) Prior Publication Data

US 2004/0002294 A1 Jan. 1, 2004

(30) Foreign Application Priority Data

Jun. 28, 2002 (DE) ..... 202 10 021 U

(51) Int. Cl.[7] ..... B24B 23/00
(52) U.S. Cl. ..... 451/347; 451/429
(58) Field of Search ..... 451/347, 429, 451/439, 344, 65, 236

(56) References Cited

U.S. PATENT DOCUMENTS 2,073,816 A * 3/1937 Talboys ..... 451/347
3,883,323 A * 5/1975 Cooley ..... 451/347
4,135,332 A * 1/1979 Theurer ..... 451/72
4,896,460 A * 1/1990 Theurer et al. ..... 451/347
5,735,734 A * 4/1998 Hertelendi ..... 451/347

FOREIGN PATENT DOCUMENTS

| | | |
|---|---|---|
| DE | 42 20 456 | 10/1993 |
| EP | 0 743 395 | 3/1999 |
| EP | 1 178 154 | 2/2002 |

* cited by examiner

*Primary Examiner*—Hadi Shakeri
(74) *Attorney, Agent, or Firm*—Collard & Roe, P.C.

(57) ABSTRACT

A rail grinding machine comprises a machine frame having guide wheels running on the rail, a follower frame mounted on the machine frame, the follower and machine frames being pivotally connected for pivoting about an axis extending in the longitudinal direction, and the follower frame having sensing rollers running on the rail of the track. A rail grinding device is mounted on the follower frame for adjustment relative to the rail, a drive motor for driving the rail grinding device is vertically adjustably mounted on a vertical guide connected to the machine frame, and a transmission connects the drive motor to the rail grinding device.

7 Claims, 2 Drawing Sheets

RAIL GRINDING MACHINE

BACKGROUND OF THE INVENTION

1. Field of the Invention

Figure 1:
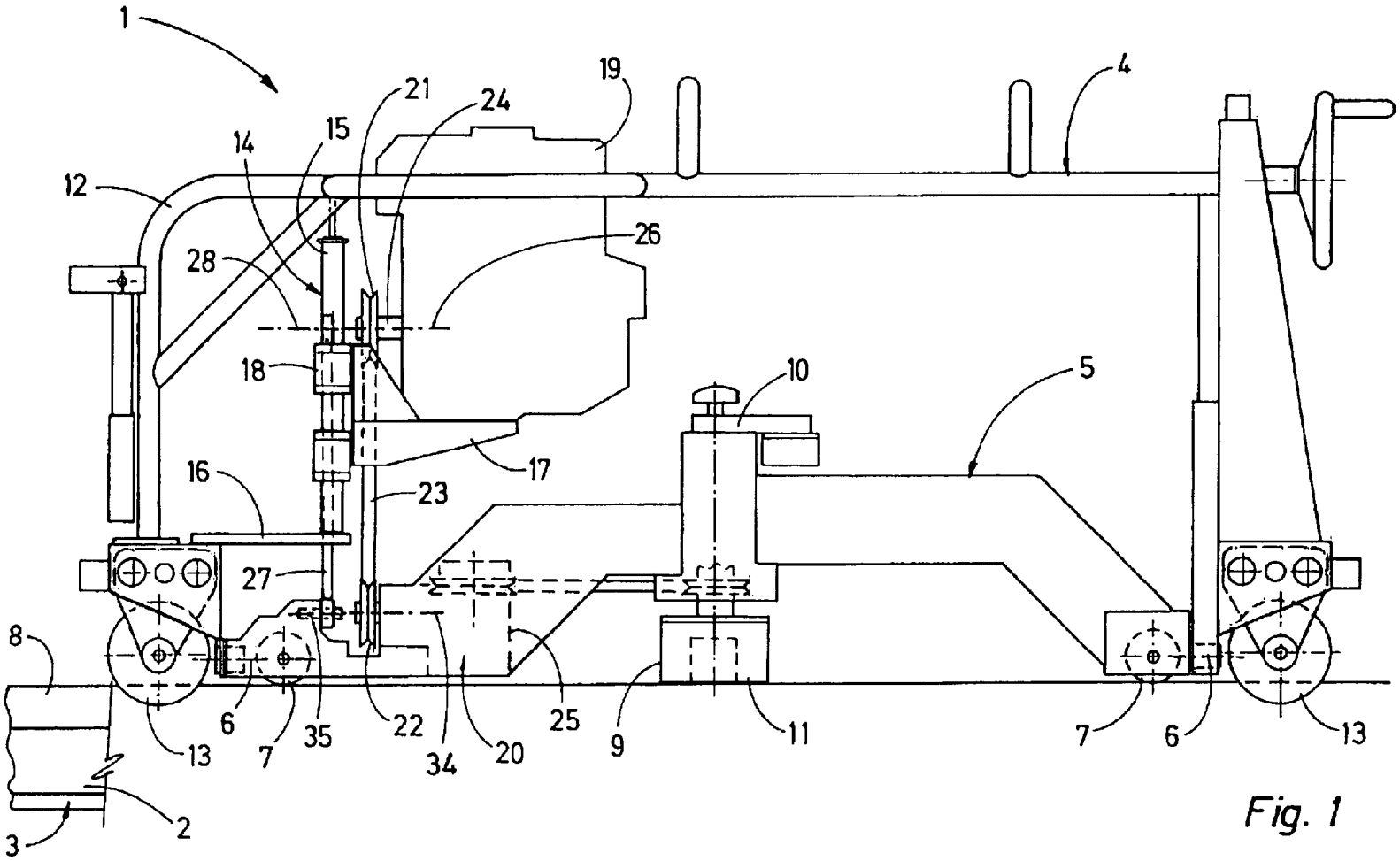

The present invention relates to a machine for grinding the rail of a track extending in a longitudinal direction, which comprises a machine frame having guide wheels running on the rail of the track, a follower frame pivotally connected with the machine frame for pivoting about an axis extending in the longitudinal direction, the follower frame having sensing rollers running on the rail, a rail grinding device mounted on the follower frame for adjustment relative to the rail, a drive motor for driving the rail grinding device relative to the rail, and a transmission connecting the drive motor to the rail grinding device.

2. Description of the Prior Art

EP 0 743 395 B1 describes a machine of the above-indicated type. Power is transmitted from the drive motor to the rail grinding device by a miter gear mounted on the follower frame and connected to the drive motor by a flexible shaft. A pulley-and-belt drive transmits the power from the miter gear to the rail grinding device. During grinding of the rail head contour, the follower frame with the transmission must be pivoted about 180° from one side of the rail to the other. To enable this pivoting motion to be effected as unhindered as possible, the shaft must have a relatively small diameter to assure flexibility. However, this shaft is subjected to strong forces during the grinding operation.

EP 1 178 154 A1 discloses a rail grinding machine wherein the drive motor is mounted on a carrier linked to the machine frame as well—by an intermediate member—to the follower frame for pivoting about an axis extending parallel to the rails. The intermediate member also serves as a housing for the drive belt. The rotation of the follower frame about the axis results in the vertical adjustment of the carrier along a circular path, the ends of the bow-shaped carrier being connected to the follower frame, and causes a sideways tilting of the drive motor from the horizontal.

Finally, it is known from DE 42 20 456 C1, for example, to mount the drive motor together with the rail grinding tool on an auxiliary frame which is mounted on the follower frame on guide rods for adjustment vertically to the rails.

SUMMARY OF THE INVENTION

It is the primary object of this invention to provide a rail grinding machine of the first-described type, which enables a simple and dependable power transmission from the drive motor to the grinding device during all phases of the grinding operation.

In such a machine, this and other objects are accomplished with a drive motor which is vertically adjustably mounted on a vertical guide connected to the machine frame.

This structure provides the advantageous possibility to connect the drive motor pivotally with the follower frame so that the drive motor will be vertically adjusted in a simultaneous motion compensating for the pivoting motion of the follower frame about an axis extending parallel to the rails of the track. At the same time, this dependably assures that the drive motor remains in an unchanged vertical position during all operating phases, which is of particular importance with the use of internal combustion engines.

BRIEF DESCRIPTION OF PREFERRED EMBODIMENT

Figure 3:
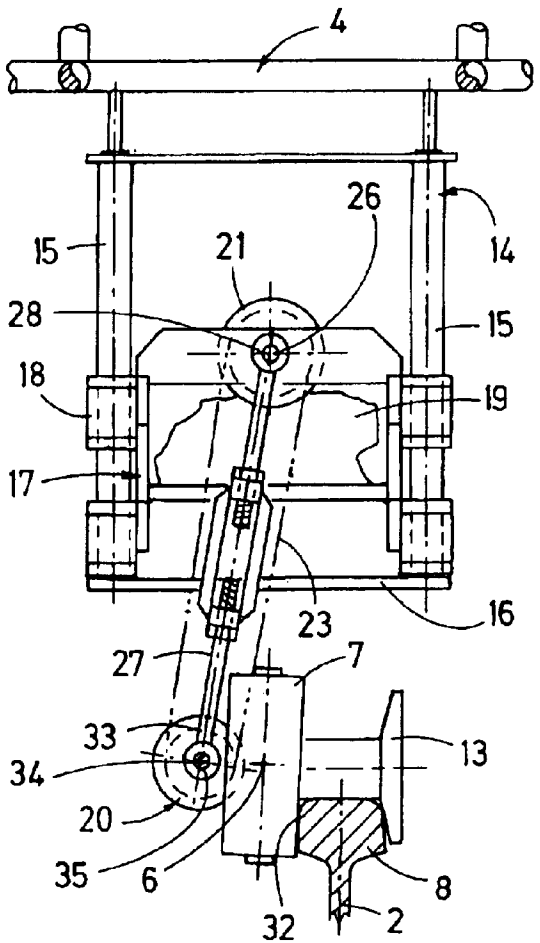
Figure 2:
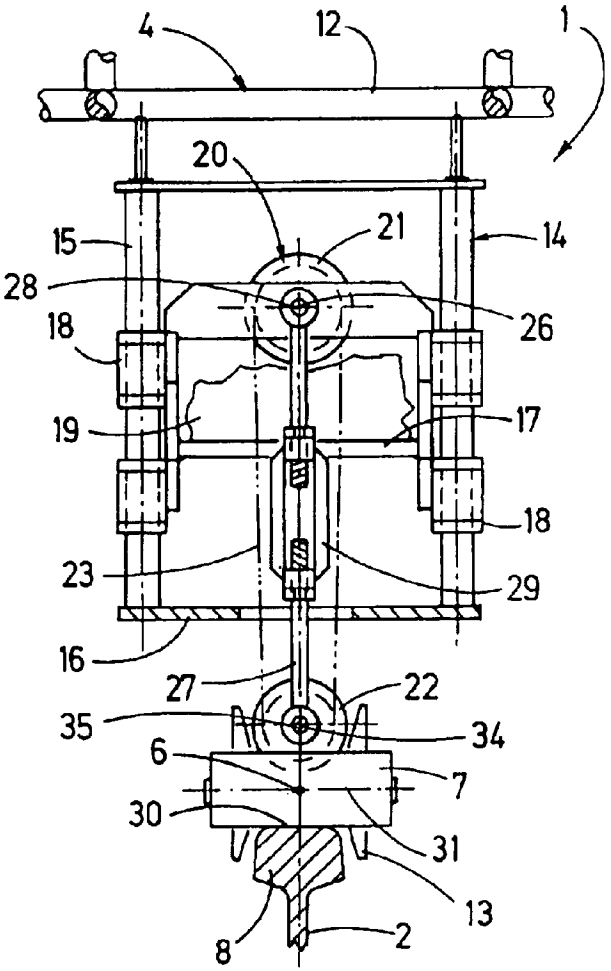

The above and other objects, advantages and features of the invention will become more apparent from the following detailed description of a now preferred embodiment thereof, taken in conjunction with the accompanying drawing wherein FIG. 1 is a somewhat schematic, side elevational view of a rail grinding machine according to the present invention; and FIGS. 2 and 3 are fragmentary end views, partly in section, showing different operating positions.

DETAILED DESCRIPTION OF THE PREFERRED EMBODIMENT

Referring to the drawing, and especially to FIG. 1, there is shown a machine 1 for grinding rail 2 of track 3. The machine comprises yoke-shaped machine frame 4 having guide wheels 13 at its two ends and running on the rail of the track. The guide wheels are preferably double-flanged wheels and are transversely glidably mounted on the machine frame for transverse adjustment relative thereto. A follower frame 5 has two ends mounted on machine frame 4, and the machine and follower frames are pivotally connected for pivoting about axis 6 extending in the longitudinal direction. Follower frame 5 has two sensing rollers 7, 7 spaced from each other in the longitudinal direction of track 3 and running on rail head 8 of rail 2 to be ground. As is known from U.S. Pat. No. 5,735,734 and, therefore, not explained in detail herein, when follower frame 5 is tilted sideways about axis 6 and, as a result, is lowered, guide wheels 13 continue to run on rail head 8 and thus guide machine frame 4 on rail 2 to be ground while a boom (not shown) supports the machine frame on the other rail of the track.

Centered between the two sensing rollers, a rail grinding device 9 is mounted on follower frame 5 for adjustment by drive 10 relative to the rail. The rail grinding device comprises a rotary grinding tool 11, and drive 10 drives the rail grinding device relative to the rail. As best shown in FIGS. 2 and 3, drive motor 19 is vertically adjustably mounted on vertical guide 14 connected to machine frame 4. In the preferred embodiment, vertical guide 14 is comprised of two guide rods 15 transversely spaced from each other with respect to track 3. The upper ends of the guide rods are affixed to machine frame yoke 12 while the lower ends thereof are mounted on plate 16 disposed on machine frame 4. A bracket-shaped support frame 17 supports the drive motor, which is affixed to support frame 17. The support frame is slidably mounted on the vertical guide rods 15 by sliding collars 18 so that drive motor 19 is vertically adjustable on machine frame 4.

A transmission 20 connects drive motor 19 to rail grinding device 9. The drive motor is preferably an internal combustion engine, and the transmission comprises two vertically spaced belt pulleys 21, 22 and drive belt 23. Upper belt pulley 21 is connected directly to drive shaft 24 of motor 19 while lower pulley 22 is connected to angle transmission 25 mounted on follower frame 5, which is in force-transmitting connection with grinding device 9. The axes of rotation 26, 34 of pulleys 21, 22, respectively, extend parallel to pivoting axis 6.

A connecting rod 27 connects support frame 17, to which drive motor 19 is affixed, to follower frame 5. Connecting rod 27 is mounted on the support and follower frames for rotation about axis 35 extending parallel to pivoting axis 6, which links drive motor 19 to follower frame 5 for rotation about an axis extending in the longitudinal direction. Pulleys 21, 22 are rotatable respectively about axes 26, 34 aligned with axes of rotation 28, 35 about which connecting rod 27 rotates on follower frame 5 and about which drive motor 19 rotates on the connecting rod. Connecting rod 27 has an adjustable length, and a turnbuckle 29 enables the length of the connecting rod to be adjusted. Lengthening connecting rod 27 enables drive belt 23 to be tensioned while a shortening of the connecting rod enables the belt to be replaced.

The operating position shown in FIG. 2 shows an operating phase in which horizontally extending running surface 30 of rail head 8 is ground. In this case, axes of rotation 31 of sensing rollers 7 running on rail 2 extend horizontally, and axis of rotation 34 of lower pulley 22 is centered vertically above pivoting axis 6.

FIG. 3 shows an operating position wherein a side 32 of rail head 8 is ground. In this operating phase, follower frame 5 is pivoted about axis 6 so that sensing rollers 7 run on rail head side 32. Pivoting of follower frame 5 results in lower end 33 of connecting rod 27, which is linked to the follower frame, to be pivoted with the follower frame and thereby to be lowered. The connecting rod, in turn, entrains support frame 17 and causes the support frame with drive motor 19 affixed thereto to be lowered along guide device 14. Since the pivoting axes 28, 35 of connecting rod 27 and axes of rotation 26, 34 of pulleys 21, 22 are aligned, the pivoting motion in no way impairs the force transmission from drive motor 19 to angle transmission 25.

What is claimed is:

1. A machine for grinding the rail of a track extending in a longitudinal direction, which comprises (a) a machine frame having guide wheels running on the rail of the track, (b) a follower frame mounted on the machine frame, the follower and machine frames being pivotally connected for pivoting about an axis extending in the longitudinal direction, and the follower frame having sensing rollers running on the rail of the track, (c) a rail grinding device mounted on the follower frame for adjustment relative to the rail, (d) a drive motor for driving the rail grinding device, the drive motor being vertically adjustably mounted on a vertical guide connected to the machine frame and being linked to the follower frame for rotation about an axis extending in the longitudinal direction, and (e) a transmission connecting the drive motor to the rail grinding device.

2. The machine of claim 1, further comprising a connecting rod connecting the drive motor to the follower frame, the connecting rod being mounted on the follower frame for rotation about an axis extending in the longitudinal direction and the drive motor being connected to the connecting rod for rotation about an axis extending in the longitudinal direction.

3. The machine of claim 2, wherein the connecting rod has an adjustable length.

4. The machine of claim 3, further comprising a turnbuckle for adjusting the length of the connecting rod.

5. The machine of claim 2, further comprising a bracket-shaped support frame, the drive motor being affixed to the support frame, and the support frame being slidably mounted on the vertical guide and being connected to the connecting rod for rotation therewith.

6. The machine of claim 2, wherein the transmission comprises two vertically spaced belt pulleys and a drive belt, the belt pulleys being rotatable respectively about an axis aligned with the axis of rotation about which the connecting rod rotates on the follower frame and of the axis of rotation about which the drive motor rotates on the connecting rod.

7. The machine of claim 1, wherein the vertical guide is comprised of two guide rods transversely spaced from each other with respect to the track.

* * * * *